US010235910B1

(12) United States Patent
Graham et al.

(10) Patent No.: US 10,235,910 B1
(45) Date of Patent: Mar. 19, 2019

(54) SPLIT SIGNAGE ASSEMBLY

(71) Applicant: INTERNATIONAL PAPER COMPANY, Memphis, TN (US)

(72) Inventors: Danielle Helms Graham, Fort Mill, SC (US); James Bradley Griffin, Rock Hill, SC (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/031,728

(22) Filed: Jul. 10, 2018

(51) Int. Cl.
*G09F 15/00* (2006.01)
*G09F 7/18* (2006.01)

(52) U.S. Cl.
CPC ..... *G09F 15/0012* (2013.01); *G09F 7/18* (2013.01); *G09F 2007/186* (2013.01); *G09F 2007/1843* (2013.01)

(58) Field of Classification Search
CPC ..... G09F 15/0012; G09F 7/18; G09F 2007/1843; G09F 2007/186
See application file for complete search history.

(56) References Cited

U.S. PATENT DOCUMENTS 265,836 A 10/1882 Lindner et al.
1,513,521 A 10/1924 Robertson
2,028,506 A 1/1936 Enoch
D199,834 S * 12/1964 Smith ..... D20/20
3,201,881 A * 8/1965 Dechar ..... G09F 13/00 362/35
3,340,633 A * 9/1967 Silberman ..... G09F 11/02 248/129
3,964,190 A 6/1976 Leo
4,001,959 A * 1/1977 Grendahl ..... A47G 1/0616 40/506
4,392,316 A 7/1983 Thomas
D336,622 S * 6/1993 Kinnicutt ..... D11/130.1
5,372,269 A 12/1994 Sutton et al.
5,649,379 A 7/1997 Hoffman et al.
6,477,800 B1 * 11/2002 Payne ..... G09F 7/18 40/582
6,671,988 B2 1/2004 Cyrluk
7,610,704 B1 * 11/2009 Nowicki ..... G09F 19/02 40/429
2006/0165529 A1 * 7/2006 Sobel ..... F04D 25/088 416/210 R
2006/0242866 A1 11/2006 Rutkowski
2012/0137550 A1 * 6/2012 Stafford ..... G09F 7/18 40/541
2013/0306516 A1 11/2013 Dougherty et al.

FOREIGN PATENT DOCUMENTS

GB 2350785 A 12/2000

* cited by examiner

*Primary Examiner* — Gary C Hoge
(74) *Attorney, Agent, or Firm* — Thomas W. Ryan; Michael D. Folkerts

(57) ABSTRACT

A signage assembly is provided comprising a frame structure including a top disc, a bottom disc, and a plurality of elongated disc supports extending between the top and bottom discs. Each of the top and bottom discs include first and second disc halves connected at disc-half edges to form the top and bottom discs as respective disc assemblies. A hinge connection pivotally connects each of the disc supports to at least one of the top and bottom discs. A flexible placard structure is attached to the frame structure surrounding an outer periphery of the top and bottom discs.

18 Claims, 7 Drawing Sheets

SPLIT SIGNAGE ASSEMBLY

FIELD OF THE INVENTION

This invention relates generally to a display sign and, more particularly, to a display sign that may be shipped in a disassembled condition and assembled at a point of sale for use.

BACKGROUND OF THE INVENTION

Retail establishments often make use of hanging posters or signs to advertise products, such as to draw customer attention to a particular location in the store. In some instances, the signs are simply posters that are printed on opposite sides of a poster board or paper which may be secured to a wall or window area or which may be suspended from the ceiling. Such conventional signs must be strategically positioned within a store so as to be readily viewable by customers. As such signs generally include advertising on only two sides, and the advertising is displayed in opposite directions, a limited field of visual display is created.

In alternative displays designed to overcome the shortcomings of two-sided posters, three-dimensional hanging signs having a plurality of panels permitting viewing from various viewing angles within a store have been proposed. Such three-dimensional signs can be supplied to a point of sale pre-assembled, or may include a plurality of parts that may require difficult manipulation of plural attachment locations between the parts to assemble. Additionally, shipping costs for three-dimensional sign structures, or kits for forming the signs, can operate as a disincentive for utilizing the full potential of providing such signs to a retail environment. Specifically, in addition a basic shipping cost, shipping carriers often assess a surcharge for shipping oversized packages, such that sign panel size or overall sign size, e.g., length and/or width, may be limited by a requirement to select the final dimensions of the sign to fit within the predetermined packaging dimensions set by the carrier. Alternatively, larger signage may necessitate use of larger/oversized shipping containers with associated higher shipping costs. Hence, there is a continuing need for display signage that provide a large presence in a store, can be economically shipped, and can be readily set up at a point of sale to provide an attractive display appearance.

SUMMARY OF THE INVENTION

In accordance with an aspect of the invention, a signage assembly is provided comprising a frame structure including a top disc, a bottom disc, and a plurality of elongated disc supports extending between the top and bottom discs. A hinge connection pivotally connects each of the disc supports to at least one of the top and bottom discs. A flexible placard structure is attached to the frame structure surrounding an outer periphery of the top and bottom discs.

Each disc support can include a back wall, opposing side walls, and a front wall formed from a blank comprising at least a first back panel, a first side panel, a front panel, and a second side panel connected in series at first, second, and third vertically extending fold lines.

The disc support can include tabs foldably connected to opposing top and bottom edges of the back wall and defining the hinge connections between the disc supports and the discs.

The blank can further comprise a second back panel connected to the second side panel at a fourth fold line and located in overlapping relationship adjacent to the first back panel.

The top and bottom discs can each comprise first and second generally planar disc halves including disc-half edges joined at slidable connections.

Each disc-half can include one or more of a slot and a tongue extending from a respective disc-half edge parallel to the plane of the disc halves, and the slidable connections can be defined by each tongue slidably received within a respective slot.

At least one stand-off structure can be supported on the placard structure, including a sign radially offset from the placard structure.

The stand-off structure can comprise a sign panel having an outer side facing in a radially outward direction, and a mounting panel attached to an inner side of the sign panel opposite the outer side and can include mounting portions slidably engaged through the placard structure.

The mounting panel can include a main body, and the mounting portions can comprise mounting tabs foldably connected to the main body at lateral edges and locating tabs foldably connected to the main body at top and bottom edges, wherein the mounting tabs can include vertically facing hooks engaged through slits in the placard structure for supporting the stand-off structure.

In accordance with another aspect of the invention, a signage assembly is provided comprising a frame structure including a top disc, a bottom disc, and a plurality of elongated disc supports extending between the top and bottom discs. The top disc includes first and second disc halves connected at disc-half edges to form the top disc as a disc assembly. The bottom disc includes first and second disc halves connected at disc-half edges to form the bottom disc as a disc assembly. A flexible placard structure is attached to the frame structure surrounding an outer periphery of the top and bottom discs.

The top and bottom discs can include slidable connections formed by complementary elements extending between respective connected disc halves.

The complementary elements can be defined by one or more of a slot and a tongue extending from a respective disc-half edge, and the slidable connections can be defined by each tongue slidably received within a respective slot.

Each of the top and bottom discs can be formed of a sheet of corrugated material forming an inner layer and two sheets of corrugated material on either side of the inner layer defining two outer layers, wherein the one or more slots can be formed by slot portions of the inner layer located between the two outer layers and the one or more tongues can be formed by tongue portions of the inner layer extending beyond the disc-half edges defined by the two outer layers.

The inner layer can be defined by double wall corrugated material, and each of the two outer layers can be defined by single wall corrugated material.

In accordance with a further aspect of the invention, a method is provided for constructing a signage assembly from top and bottom discs, a plurality of disc supports connected to at least one of the discs, and a placard structure. The method comprises: pivoting the disc supports about a hinge connection from a position generally parallel to a first disc to a position generally perpendicular to the first disc, the first disc defining one of the top and bottom discs; forming a connection between each disc support and a second disc to form a frame structure, the second disc defining the other of the top and bottom discs; and bending the placard structure around the frame structure and attaching the placard structure to the frame structure to form a cylindrical configuration for the signage assembly.

Attaching the placard structure to the frame structure can comprise attaching the placard structure to one or more of the disc supports.

Each of the top and bottom discs can be formed of pairs of disc halves, and the method can further include moving the respective pairs of disc halves toward each other to engage complementary structures of the disc halves together to form the top and bottom discs.

The complementary structures of the disc halves can comprise tongues inserted into slots formed in edges of the disc halves.

A stand-off structure having mounting tabs can be provided, and the method can further include inserting the mounting tabs radially through the placard structure to support the stand-off structure on the placard structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
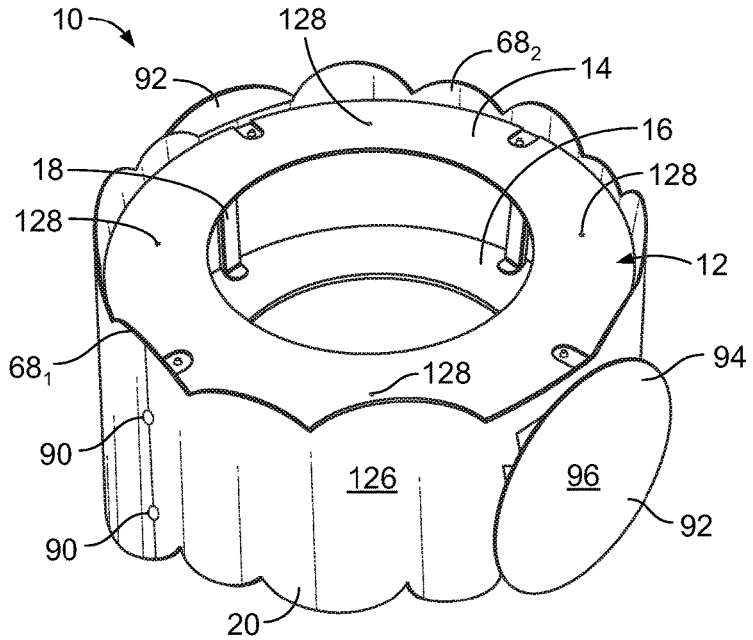
FIG. 1 is a perspective view of a signage assembly.

The present description is directed to a point of sale signage assembly 10 that can be suspended from a ceiling and provide a large presence at a retail location, wherein the signage assembly 10 can be provided as a disassembled system of relatively small component parts and can be readily constructed into a display sign for use at the retail location. As seen in FIG. 1, the signage assembly 10 generally includes a frame structure 12 formed of a pair of discs, i.e., a top disc 14 and a bottom disc 16, connected to opposing ends of elongated disc supports 18, and a flexible placard structure 20 supported to an outer periphery of the frame structure 12, see FIG. 1.

Figure 2A:
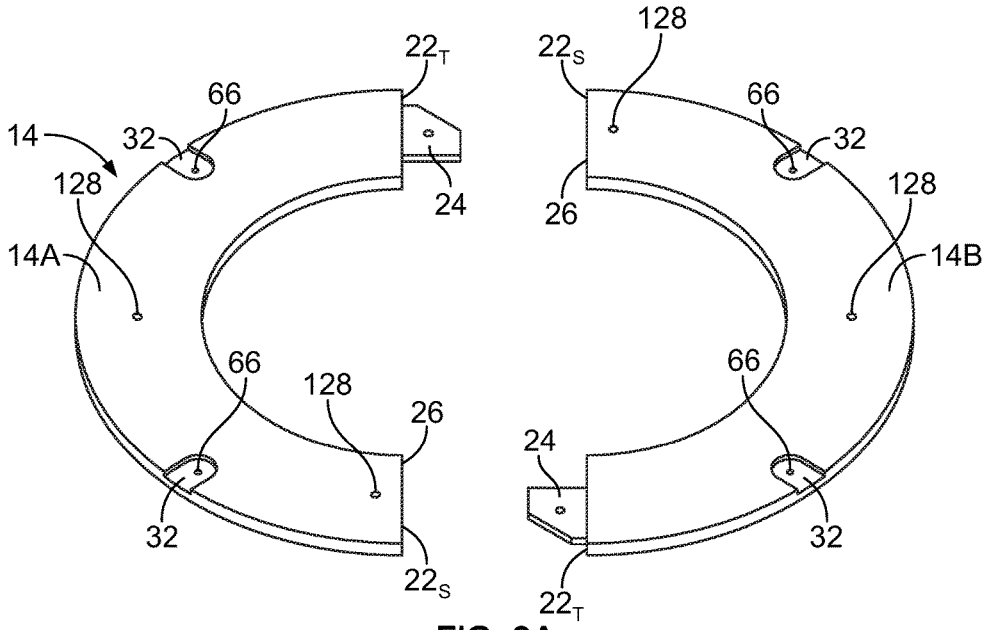
FIG. 2A is a perspective view of a lower side of a pair of disc halves for forming a top disc.
Figure 2B:
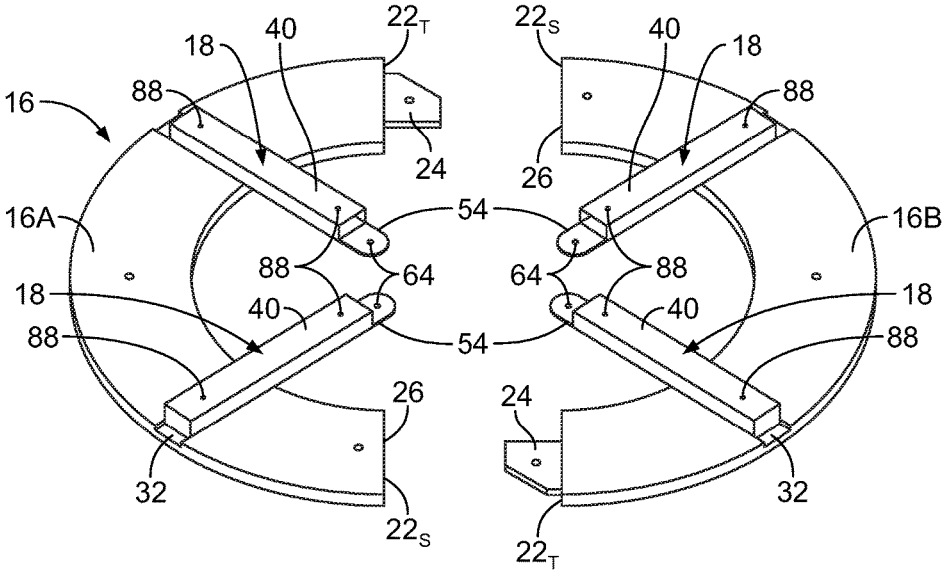
FIG. 2B is a perspective view of an upper side of an assembly including a pair of disc halves for forming a bottom disc and attached disc supports.

Referring to FIGS. 2A and 2B, the frame structure 12 is formed as a split frame configuration including the top and bottom discs 14, 16 that comprise assemblies of respective pairs of generally planar disc halves 14A, 14B and 16A, 16B, wherein the individual disc halves 14A, 14B, 16A, 16B can be identical structures. In the views illustrated herein, the disc halves 14A, 14B, 16A, 16B are depicted as semi-circular discs that are assembled to form circular discs 14, 16. Further, the discs 14, 16 are configured as annular rings, providing a reduction of material and an associated reduction in weight, while also providing an open feel to the final signage assembly 10. However, it should be noted that the discs 14, 16 are not limited to a particular shape, such as the circular configuration depicted herein, and it should be understood that the discs 14, 16 may be configured to form any closed curve shape, and may include various polygon shapes, to support a sign extending around the periphery of the frame structure 12, as is described further below.

The disc halves 14A, 14B, 16A, 16B each define disc-half edges $\mathbf{22}_S$, $\mathbf{22}_T$ that can be joined at slidable connections. In an exemplary slidable connection, the disc-half edges $\mathbf{22}_S$ and $\mathbf{22}_T$ are formed at opposing sides of the disc halves 14A, 14B, 16A, 16B and can include a respective tongue 24 and slot 26 (see FIG. 3) defining complementary cooperating members of the slidable connection. The tongue 24 extends outwardly from the disc-half edge $\mathbf{22}_T$ and the slot 26 extends inwardly from the disc-half edge $\mathbf{22}_S$, i.e., into the interior of a disc half 14A, 14B, 16A, 16B. Hence, the slidable connections for constructing the discs 14, 16 are defined by the tongues 24 slidably received within the slots 26 in a direction parallel to the plane of the disc halves 14A, 14B, 16A, 16B to form a friction fit between the pairs of disc halves 14A, 14B and 16A, 16B defining the assembled discs 14, 16, as is illustrated by the assembled bottom disc 16 in FIG. 4. It should be understood that, although each disc half of a disc pair is described as including a tongue 24 and a slot 26, alternative embodiments may be formed including providing one disc half with a pair of tongues 24 and the opposing disc half provided with a pair of slots 26 for receiving the pair of tongues 24 in sliding engagement.

Figure 3:
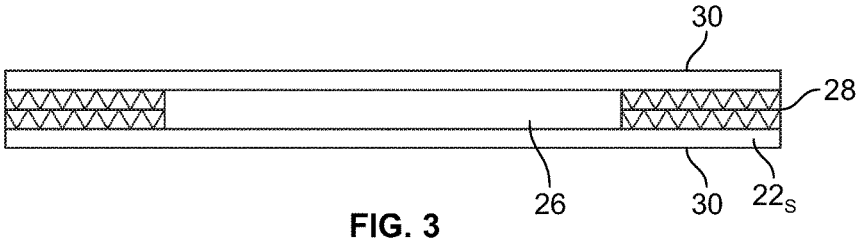
FIG. 3 is an edge view of a slot for a disc half.

A construction for the disc halves 14A, 14B, 16A, 16B is illustrated in FIG. 3. Each disc half 14A, 14B, 16A, 16B can be formed of plural layers of corrugated material, e.g., corrugated cardboard material. Specifically, the disc halves 14A, 14B, 16A, 16B can comprise an inner sheet of corrugated material 28 defining an inner layer, and two outer sheets 30 of corrugated material defining outer layers attached to opposing sides of the inner sheet of corrugated material 28. The inner sheet of material 28 can comprise a double wall corrugated material and the outer sheets of material 30 can each comprise a single wall corrugated material, and the corrugations of the inner sheet of material 28 can extend transverse, e.g., perpendicular, to the corrugations of the outer sheets of material 30. The tongue 24 is defined by an extension of the inner sheet of material 28 beyond the disc-half edge $22_T$, and the slot 26 is defined by a cut-out or slotted area of the inner sheet of material 28, wherein a space for receiving the tongue 24 of an adjacent disc half is formed between the two outer sheets of material 30.

Figure 5A:
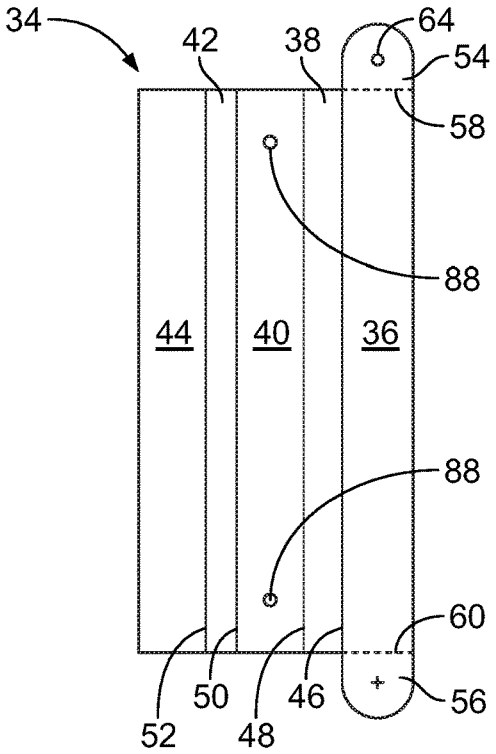
FIG. 5A is a plan view of a blank for forming a disc support.
Figure 5B:
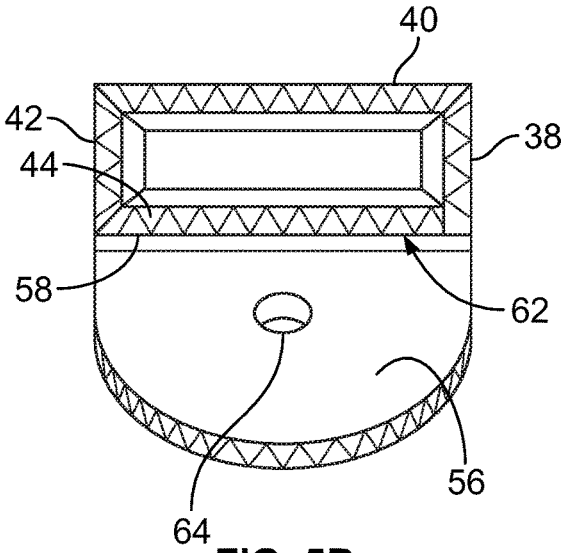
FIG. 5B is an end view of an assembled disc support.

Referring to FIGS. 2A and 2B, the disc supports 18 connecting the top and bottom discs 14, 16 are attached at notches 32 formed by circumferentially spaced cut-outs in the outer sheets 30. As may be seen in FIG. 5B, each disc support 18 is a hollow, square tubular structure formed from a folded corrugated blank 34, see FIG. 5A. The blank 34 for forming the disc support 18 comprises a first back panel 36, a first side panel 38, a front panel 40, a second side panel 42, and second back panel 44 connected in series at first, second, third, and fourth vertically extending fold lines 46, 48, 50, 52, respectively. First and second tabs 54, 56 are foldably connected to opposing ends of the first back panel 36 at fold lines 58, 60. As seen in FIG. 5B, the blank 34 can be folded to form the hollow structure of the disc support 18 having a back wall 62 formed by the first back panel 36 adhered to the second back panel 44, a first side wall formed by the first side panel 38, a front wall formed by the front panel 40, and a second side wall formed by the second side panel 42 and located opposite the first side wall.

Figure 4:
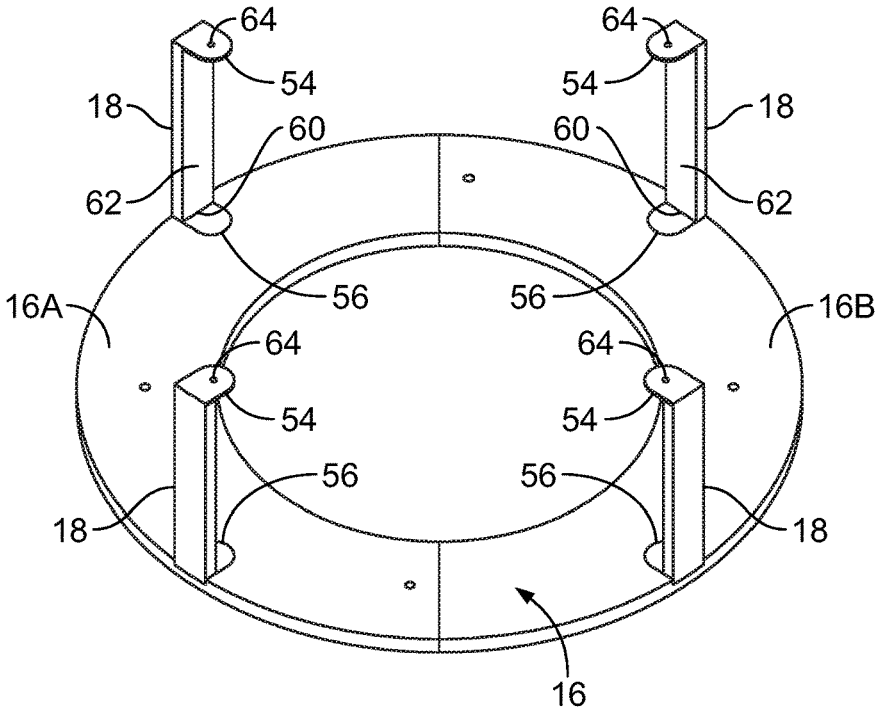
FIG. 4 is a perspective view of a bottom disc assembly including joined disc halves and attached disc supports pivoted to an upright position prior to attachment of a top disc.

The tabs 54, 56 define connecting structure for attaching the disc supports 18 to the top and bottom discs 14, 16. Referring to FIGS. 2B and 4, the tabs 56 of the disc supports 18 are attached to the bottom disc 16 at the notches 32. In the illustrated embodiment, the bottom disc 16 may be provided preassembled with tabs 56 of the disc supports 18 attached to the bottom disc 16 at the notches 32. The tabs 56 are preferably permanently adhered to the bottom disc 16, such as by means of a glue joint, to facilitate assembly of the frame structure 12 by an end user. However, it should be understood that the tabs 56 may be assembled to bottom disc 16 by alternative attachment means such as, without limitation, fasteners, clips, tape, or staples. The fold line 60 adjacent to the tab 56 of each disc support 18 defines a hinge connection for pivotally connecting the disc supports 18 to the bottom disc 16. The hinge connections defined by the fold lines 60 permit the disc supports 18 to rest in a shipping orientation extending generally parallel a respective disc half 16A, 16B of the bottom disc 16. It should be noted that, although four disc supports 18 are illustrated herein as a preferred embodiment for connecting the discs 14, 16, more or fewer disc supports 18 may be provided.

In an initial step of assembling the frame structure 12, following assembly of the pairs of disc halves 14A, 14B and 16A, 16B to form the top and bottom discs 14, 16, the disc supports 18 can be pivoted about the fold lines 60 to a position generally perpendicular to the bottom disc 16, see FIG. 4. The upward pivoted position of the disc supports 18 locates the front wall, i.e., the front panel 40, of the disc supports 18 generally tangential to the outer periphery of the assembled frame structure, as defined by the outer periphery of the discs 14, 16. Subsequently, the top disc 14 can be positioned on the upper ends of the disc supports 18 with the tabs 54 pivoted perpendicular to the disc supports 18 and located within the notches 32 of the downward facing side of the top disc 14, see FIGS. 6 and 8. Fasteners 65, such as Xmas tree clip fasteners, can be inserted through aligned holes 64, 66 in the tabs 54 and top disc 14, respectively, to retain the tabs 54 engaged with the top disc 14, see FIGS. 2A, 4, and 8. The notches 32 in the discs 14, 16 can be formed with a shape that matches the shape of tabs 54, 56 to facilitate resisting twisting movement of the disc supports 18 relative to the discs 14, 16.

Figure 6:
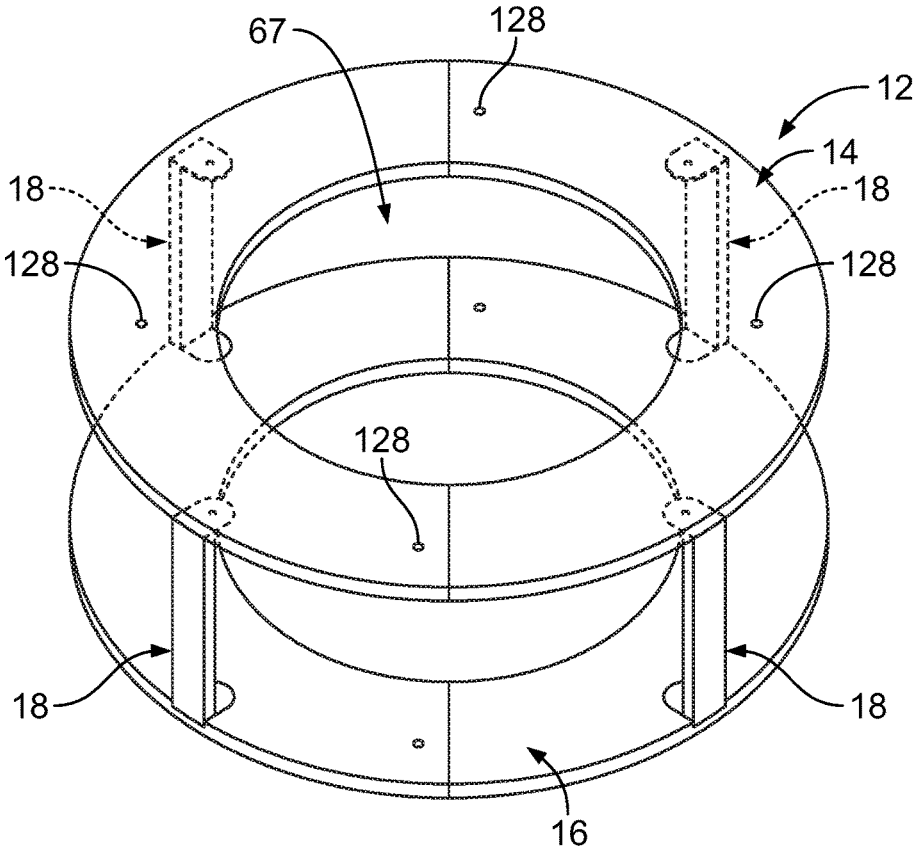
FIG. 6 is a perspective view of an assembled frame structure.

As seen in FIG. 6, the frame structure 12, as formed by the annular top and bottom discs 14, 16 and connecting disc supports 18, is configured as an open form construction, including an open center 67, that can be readily broken down to smaller components for shipping and reassembled for use. Further, the integrity of the assembled frame structure 12 is maintained by interfitting connections to form a stable, self-supporting structure that provides a mounting frame for supporting signage, as is described below.

Figure 7:
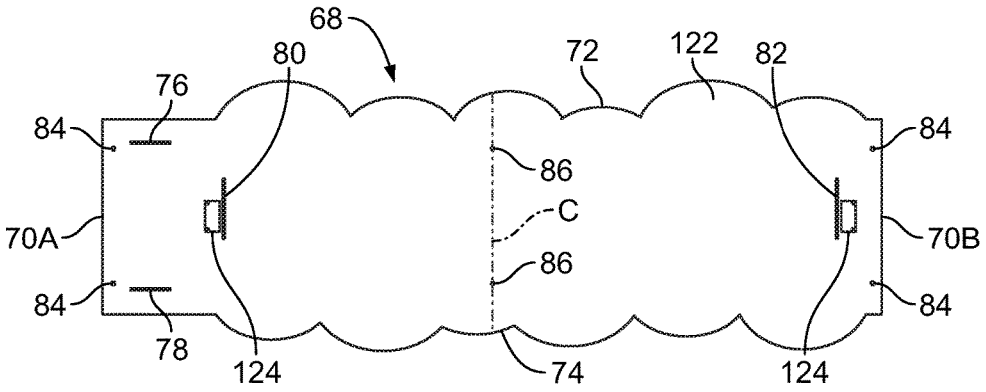
FIG. 7 is a plan view of a placard panel.

Referring to FIG. 7, the flexible placard structure 20 is formed from two identical placard panels 68 configured to extend around the periphery of the frame structure 12 defined by radially outer edges of the top and bottom discs 14, 16. In an exemplary embodiment, the placard panels 68 may be formed of a cardboard material, such as single ply paperboard. The placard panel 68 includes opposing first and second longitudinal edges 70A, 70B, and top and bottom edges 72, 74 that can be spaced apart a width dimension at least equal to or greater than a spacing between the top and bottom discs 14, 16 of the frame structure 12. A pair of vertically spaced horizontal slits 76, 78 are located adjacent to the first longitudinal edge 70A. A first vertical slit 80 is located at a vertical location between the horizontal slits 76, 78 and at a longitudinal location between the horizontal slits 76, 78 and a longitudinal center C of the placard panel 68. A second vertical slit 82 is located adjacent to the second longitudinal edge 70B of the placard panel 68 and is vertically aligned with the first vertical slot 80. Further, end mounting holes 84 may be formed adjacent to the longitudinal edges 70A, 70B, and center mounting holes 86 may be formed at the center C of the placard panel 68.

Figure 8:
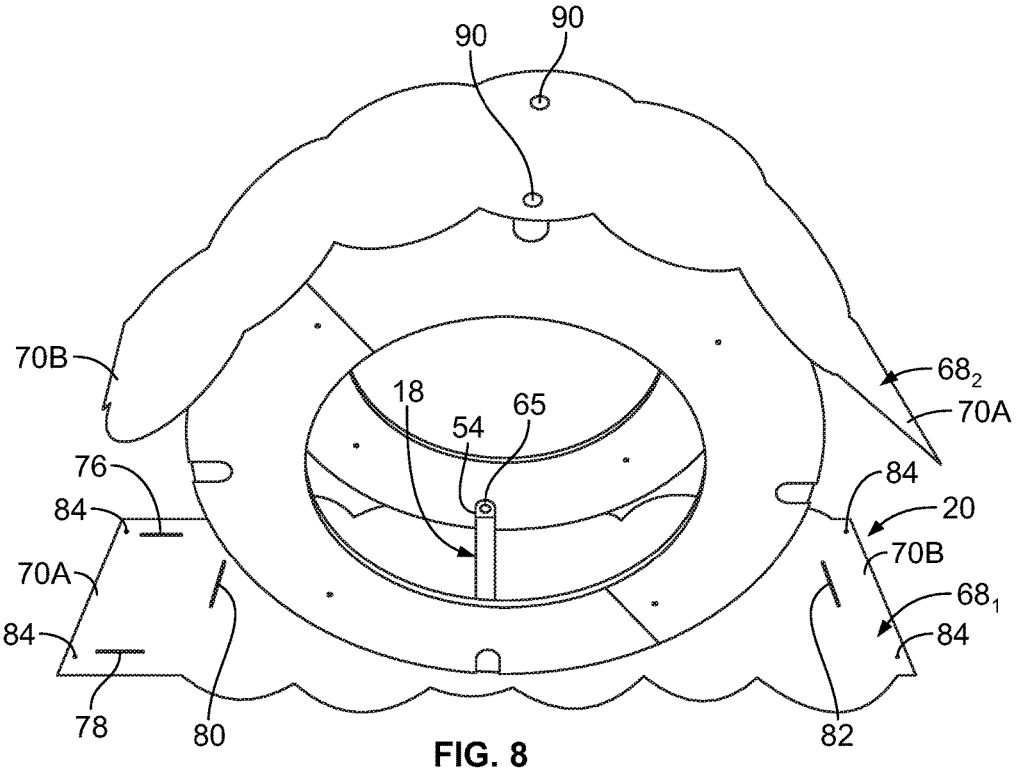
FIG. 8 is a perspective view of a pair of placard panels partially assembled to the frame structure.

Referring to FIG. 8, the placard structure 20 can be assembled to the frame structure 12 by initially attaching a first placard panel 681 to one of the disc supports 18 at the center C of the first placard panel 681. An attachment connection between the first placard panel 681 and a first disc support 18 can be formed by inserting fasteners 90 (see FIG. 1), such as Xmas tree clip fasteners, through the center holes 86 into aligned holes 88 in the front wall, i.e., front panel 40, of the disc support 18, see FIGS. 2B and 5A. Similarly, a second placard panel 682 can be attached to a diametrically opposite second disc support 18 by means of fasteners 90 extending through the center holes 86 into aligned holes 88 in the second disc support 18. Subsequently, adjacent first and second longitudinal edges 70A, 70B of the first and second placard panels 681, 682 can be bent around the discs 14, 16 into overlapping relationship with each other and positioned over an adjacent disc support 18, and fasteners 90 can be inserted through aligned end mounting holes 84 in the placard panels 681, 682 and through the holes 88 in the adjacent disc support 18, see FIG. 9. The assembled placard panels 681, 682 form the placard structure 20 as a cylindrical sign.

It should be understood that, although the above description of assembling the placard panels 681, 682 to the frame structure 12 refers to use of fasteners 90 for connecting the structures, other means of connection may be implemented including, without limitation, glue, tape, and staples.

Figure 9:
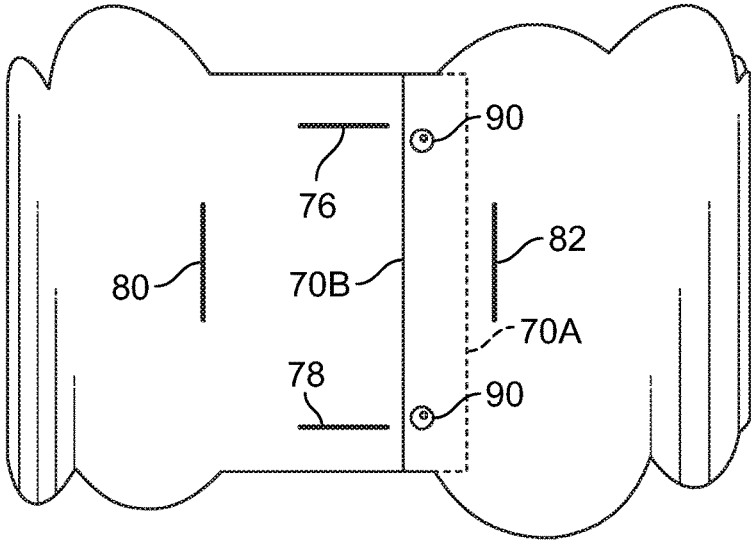
FIG. 9 is a side elevation view of a pair of placard panels assembled to the frame structure to form a cylindrical placard structure, and illustrating a mounting location on the placard structure for mounting a stand-off structure.

Referring to FIG. 9, when the placard panels 681, 682 are assembled to the frame structure 12, the first and second vertical slits 80, 82 are spaced substantially equally to opposite sides of the horizontal slits 76, 78. The slits 76, 78, 80, 82 define a mounting location for a stand-off structure 92 to position an additional sign in radially offset relation to the placard structure 20. Further, first and second sets of slits 76, 78, 80, 82 can be located on opposing sides of the cylindrical placard structure 20 for mounting respective stand-off structures 92.

Figure 10:
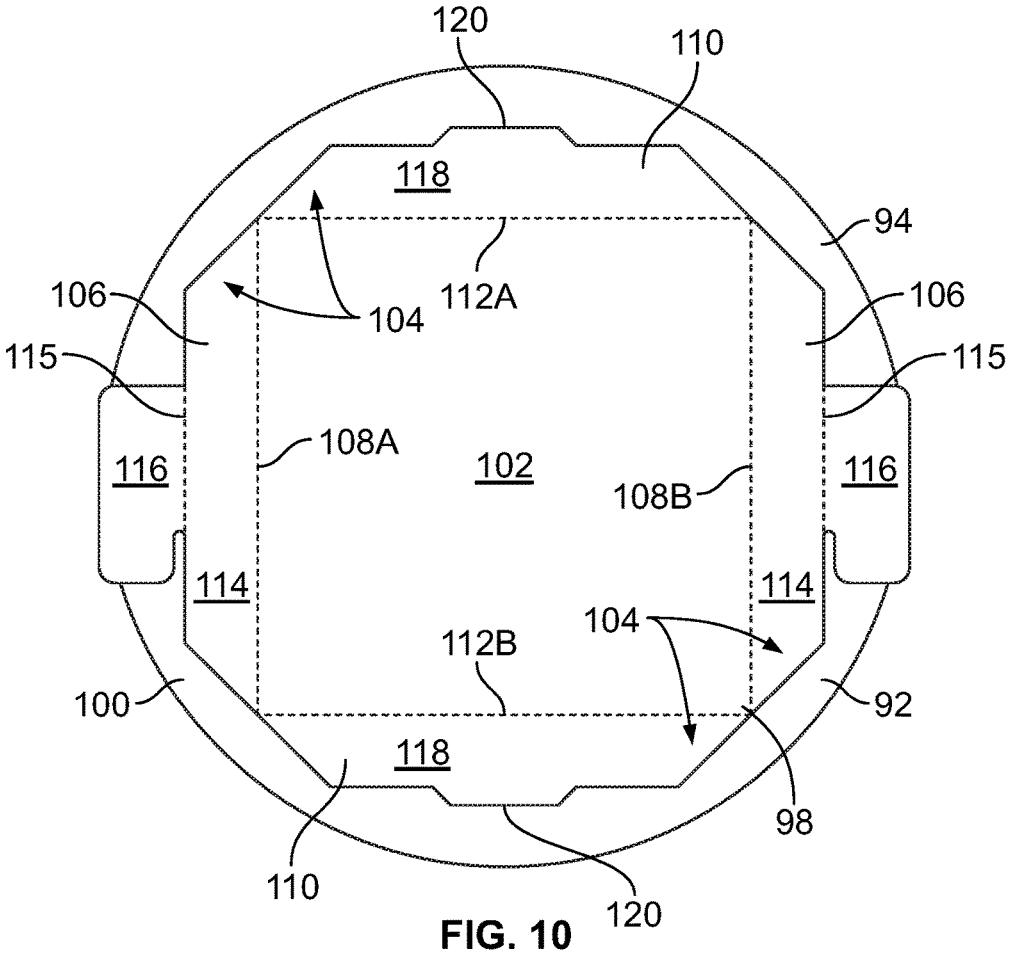
FIG. 10 is a plan view of an inward facing side of a stand-off structure.

Referring to FIG. 10, the stand-off structure 92 comprises a sign panel 94 and a mounting panel 98, each of which may be formed of a cardboard material, such as single ply paperboard. The sign panel 94 has an outer side 96 (FIG. 1) facing in a radially outward direction, and the mounting panel 98 is attached to an inner side 100 of the sign panel 94 opposite the outer side 96. Specifically, the mounting panel 98 includes a main body 102 that is affixed to the sign panel 94, and further includes mounting portions 104 that are foldably connected to the main body and that can be slidably engaged through the slits 76, 78, 80, 82 in the placard structure 20.

The mounting portions 104 comprise mounting tabs 106 foldably connected to lateral edges 108A, 108B of the main body 102, and locating tabs 110 foldably connected to top and bottom edges 112A, 112B of the main body 102. The mounting tabs 106 include a spacer panel 114 defining a spacing between the sign panel 94 and the placard structure 20 and vertically facing hooks 116, wherein the spacer panels 114 can be pivoted at the lateral edges 108A, 108B to position the mounting tabs 106 generally perpendicular to the main body 102. In the illustrated embodiment, the vertically facing hooks 116 are configured as downward facing hooks 116. The hooks 116 can be formed with a vertical dimension that is larger than the vertical dimension of the vertical slits 80, 82, and the hooks 116 are connected to respective spacer panels 114 at fold lines 115 having a vertical dimension that is less than the vertical dimension of the vertical slits 80, 82. Hence, the mounting tabs 106 can be mounted through the placard structure 20 by tilting the stand-off structure 92 to initially position a lower portion of the hooks 116 radially through the slits 80, 82, and then pivoting the stand-off structure 92 to position the fold lines 115 parallel and adjacent to the slits 80, 82.

The locating tabs 110 include a spacer panel 118 having a dimension corresponding the dimension of the spacer panel 114 defining the spacing between the sign panel 94 and the placard structure 20. Further, the locating tabs 110 include a positioning flap 120 extending outward from the spacer panel 118 and sized to radially engage through the horizontal slits 76, 78 in the placard structure 20 when the spacer panels 118 are pivoted at the top and bottom edges 112A, 112B to position the locating tabs 110 generally perpendicular to the main body 102.

Figure 11:
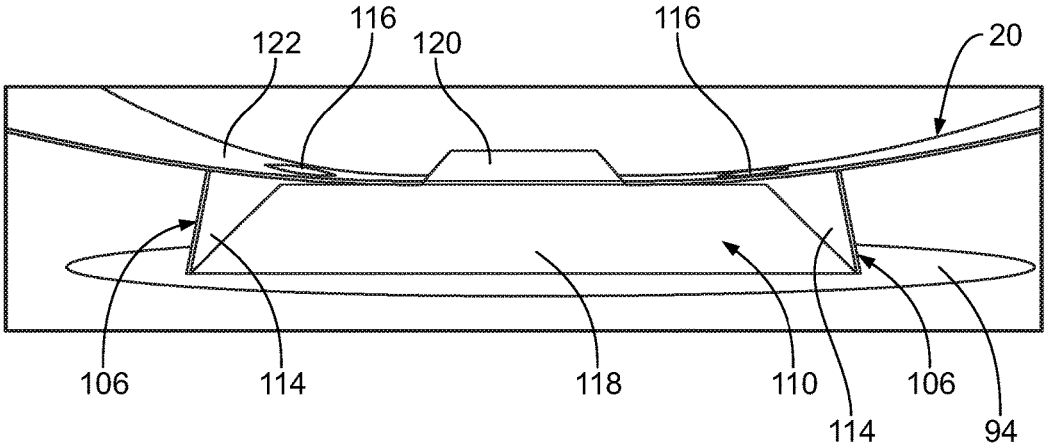
FIG. 11 is a perspective view from above of a stand-off structure mounted to the placard structure illustrating a sign radially offset from the placard structure.

Referring to FIG. 11, after the mounting tabs 106 and locating tabs 110 are engaged through the slits 80, 82 and 76, 78 in the placard structure 20, the hooks 116 may be folded about the fold lines 115 and adhered to an interior surface 122 of the placard structure 20 to immovably affix the stand-off structure 92 in position on the placard structure 20. To facilitate attachment of the hooks 116 to the interior surface 122, a section of two-sided foam tape 124 (FIG. 7) may be provided on the interior surface 122 of the placard panel 68 adjacent to each of the vertical slits 80, 82 for cooperating with an adjacent hook 116 in adhering engagement.

The placard structure 20 defines an outward facing surface 126, see FIG. 1, for the signage assembly 10 that can be provided with graphics for creating an in-store display. Further, the stand-off structures 92 may be provided with additional selected graphics that can further attract attention to the signage assembly 10. It may be understood that the signage assembly 10 can be provided with suspension hardware (not shown), e.g., wire, chain, chord, or similar hardware, to suspend the signage assembly 10 from the ceiling of a store. For example, eye bolts (not shown) may be positioned in holes 128, see FIG. 1, in the top disc 14 to provide connection points for the suspension hardware.

In a particular non-limiting, exemplary embodiment of a system for shipping the signage assembly 10, the component parts of the signage assembly 10 may be configured for shipping in a container (not shown) having approximate dimensions of 33 in.×19 in.×4 in., which defines a container dimensioned to avoid shipping carrier surcharges for oversized containers. The disc halves 14A, 14B and 16A, 16B can be formed with a radius of approximately 16 in., i.e., defining a shipping width of approximately 16 in. and length of approximately 32 in. The disc supports 18 can be formed with a length of approximately 11 in. and a front wall to back wall outer dimension of approximately ¾ in. and, when the disc supports 18 are pivoted into the lowered shipping position, the length of the disc supports 18 fits within the dimensional area of the respective bottom disc halves 16A, 16B to which they are attached. The placard panels 68 can be formed with a width of approximately 18 in. and a length of approximately 52 in., and can be folded in half to define a shipping length of approximately 26 in. The maximum dimension of the stand-off structure 92, as defined by a diameter of the sign panel 94, can be approximately 16 in. Hence, all of the components for the signage assembly 10 can be contained within the width and length dimensions of the above-described container, and can be stacked to a height of less than approximately 4 in. within the container for shipping.

As may be understood from the above description, the signage assembly 10 provides a split signage display system with an open form in the center, and allows the display to be broken down to relatively small components for shipping, as well as quickly and easily assembled. By providing cooperating tongue and slot connections 24, 26 and preassembled and attached disc supports 18, the frame structure 12 can be readily set up into a relatively large display without compromising the integrity of the display structure. Additionally, the graphics provided on the placard structure 20 can be easily and quickly attached to the frame structure 12 to be readily prepared for retail use. Further, by providing a system whereby the large signage assembly 10 can be broken down to a substantially smaller size for shipping, surcharge costs normally associated with a container for an oversized display can be avoided.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A signage assembly comprising:

a frame structure including a top disc, a bottom disc, and a plurality of elongated disc supports extending between the top and bottom discs;

a hinge connection pivotally connecting each of the disc supports to at least one of the top and bottom discs; and a flexible placard structure attached to the frame structure surrounding an outer periphery of the top and bottom discs.

2. The signage assembly as set forth in claim 1, wherein each disc support includes a back wall, opposing side walls, and a front wall formed from a blank comprising at least a first back panel, a first side panel, a front panel, and a second side panel connected in series at first, second, and third vertically extending fold lines.

3. The signage assembly as set forth in claim 2, including tabs foldably connected to opposing top and bottom edges of the back wall and defining the hinge connections between the disc supports and the discs.

4. The signage assembly as set forth in claim 2, wherein the blank further comprises a second back panel connected to the second side panel at a fourth fold line and located in overlapping relationship adjacent to the first back panel.

5. The signage assembly as set forth in claim 1, wherein the top and bottom discs each comprise first and second generally planar disc halves including disc-half edges joined at slidable connections.

6. The signage assembly as set forth in claim 5, wherein each disc-half includes one or more of a slot and a tongue extending from a respective disc-half edge parallel to the plane of the disc halves, and the slidable connections are defined by each tongue slidably received within a respective slot.

7. The signage assembly as set forth in claim 1, including at least one stand-off structure supported on the placard structure, including a sign radially offset from the placard structure.

8. The signage assembly as set forth in claim 7, wherein the stand-off structure comprises a sign panel having an outer side facing in a radially outward direction, and a mounting panel attached to an inner side of the sign panel opposite the outer side and including mounting portions slidably engaged through the placard structure.

9. The signage assembly as set forth in claim 8, wherein the mounting panel includes a main body, and the mounting portions comprise mounting tabs foldably connected to the main body at lateral edges and locating tabs foldably connected to the main body at top and bottom edges, wherein the mounting tabs include vertically facing hooks engaged through slits in the placard structure for supporting the stand-off structure.

10. A signage assembly comprising:

a frame structure including a top disc, a bottom disc, and a plurality of elongated disc supports extending between the top and bottom discs;

the top disc including first and second disc halves connected at disc-half edges to form the top disc as a disc assembly;

the bottom disc including first and second disc halves connected at disc-half edges to form the bottom disc as a disc assembly;

a flexible placard structure attached to the frame structure surrounding an outer periphery of the top and bottom discs and wherein the top and bottom discs include slidable connections formed by complementary elements extending between respective connected disc halves.

11. The signage assembly as set forth in claim 10, wherein the complementary elements are defined by one or more of a slot and a tongue extending from a respective disc-half edge, and the slidable connections are defined by each tongue slidably received within a respective slot.

12. The signage assembly as set forth in claim 11, wherein the top and bottom discs are each formed of a sheet of corrugated material forming an inner layer and two sheets of corrugated material on either side of the inner layer defining two outer layers, wherein the one or more slots are formed by slot portions of the inner layer located between the two outer layers and the one or more tongues are formed by tongue portions of the inner layer extending beyond the disc-half edges defined by the two outer layers.

13. The signage assembly as set forth in claim 12, wherein the inner layer is defined by double wall corrugated material, and the two outer layers are each defined by single wall corrugated material.

14. A method of constructing a signage assembly from top and bottom discs, a plurality of disc supports connected to at least one of the discs, and a placard structure, the method comprising:

pivoting the disc supports about a hinge connection from a position generally parallel to a first disc to a position generally perpendicular to the first disc, the first disc defining one of the top and bottom discs;

forming a connection between each disc support and a second disc to form a frame structure, the second disc defining the other of the top and bottom discs; and bending the placard structure around the frame structure and attaching the placard structure to the frame structure to form a cylindrical configuration for the signage assembly.

15. The method as set forth in claim 14, wherein attaching the placard structure to the frame structure comprises attaching the placard structure to one or more of the disc supports.

16. The method as set forth in claim 14, wherein the top and bottom discs are each formed of pairs of disc halves, and including moving the respective pairs of disc halves toward each other to engage complementary structures of the disc halves together to form the top and bottom discs.

17. The method as set forth in claim 16, wherein the complementary structures of the disc halves comprise tongues inserted into slots formed in edges of the disc halves.

18. The method as set forth in claim 14, including providing a stand-off structure having mounting tabs, and inserting the mounting tabs radially through the placard structure to support the stand-off structure on the placard structure.

* * * * *